US006376435B1

(12) United States Patent
Hafez et al.

(10) Patent No.: US 6,376,435 B1
(45) Date of Patent: Apr. 23, 2002

(54) LUBRICATION SYSTEM FOR INTERNAL COMBUSTION ENGINES (LAW952)

(75) Inventors: Mahmoud Mostafa Hafez, Philadelphia, PA (US); Ulrich Witten, Voorhees, NJ (US); Paul Simon Woolley, Morecambe (GB); Hiroki Kurosawa, Zushi (JP)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/556,737

(22) Filed: Apr. 21, 2000

(30) Foreign Application Priority Data

May 19, 1999 (GB) ..... 9911592

(51) Int. Cl.[7] ..... C10M 111/02
(52) U.S. Cl. ..... 508/492; 508/496
(58) Field of Search ..... 508/492, 496

(56) References Cited

U.S. PATENT DOCUMENTS 5,942,475 A * 8/1999 Schlosberg et al.

FOREIGN PATENT DOCUMENTS

| | | | |
|---|---|---|---|
| WO | WO-98/10040 | * | 3/1998 |
| WO | WO-98/10041 | * | 3/1998 |
| WO | WO-98/45389 | * | 10/1998 |

* cited by examiner

*Primary Examiner*—Jerry D. Johnson
(74) *Attorney, Agent, or Firm*—Joseph J. Allocca

(57) ABSTRACT

A binary two phase engine oil composition having two substantially immiscible liquid phases exhibits improved fuel economy which is maintained over an extended period. The first liquid phase comprises a base oil, natural or synthetic. The second liquid phase is a polar organic liquid, preferably a complex alcohol ester, preferably derived from a polyol, a polybasic acid, and a monohydric alcohol.

15 Claims, No Drawings

LUBRICATION SYSTEM FOR INTERNAL COMBUSTION ENGINES (LAW952)

The present invention relates to a lubrication system, particularly for the lubrication of internal combustion engines, to provide improved fuel economy and fuel economy retention.

With environmental standards becoming more strict, the ability to provide fuel economy is an important requirement for modern engine oils. Additives that have been used or proposed for this purpose include oil-soluble organo-molybdenum compounds and organic friction modifiers such as esters. Such additives provide improved initial fuel economy, to a greater or lesser extent. However, they tend to lose their effectiveness over time due to the deterioration of the engine oil during service. Recently, in addition to fuel economy performance of fresh oil, retention of fuel economy over an extended period has been given increasing attention in the industry. Therefore more effective additives are now required to provide both improved fuel economy and fuel economy retention.

Oil-soluble esters are one well-known group of additives that may enhance fuel economy performance. In general, these esters are able to provide good lubricity between sliding surfaces. The polar moieties of the molecules assist them to adsorb to metal surfaces, resulting in reduced metal-metal contact. There are many references on the use of esters and/or modified esters, e.g., sulphurised esters, to improve fuel economy. Examples include the esters described in EP-A-0853100, EP-A-0649459, WO-A-93/21288, EP-A-0206748, U.S. Pat. No. 4495088, U.S. Pat. No. 4243538 and U.S. Pat. No. 4289635. Further examples of ester lubricity additives and their use in lubricant compositions are disclosed in U.S. Pat. No. 4175047, U.S. Pat. No. 4879052 and WO 96/01302. These latter references describe esters which are groups of adipate and so-called "polyol-esters" that are derivatives of alcohols with 2 to 4 hydroxyl groups (—OH).

The present invention provides a novel approach to the problem of improving fuel economy and fuel economy retention, by providing a binary liquid system comprising two substantially immiscible liquid phases. More specifically, the present invention provides a lubrication system comprising a) a first liquid phase comprising a base oil having a kinematic viscosity at 100° C. ($KV_{100}$) in the range from 2 to 100 cSt, and b) a second liquid phase comprising a polar organic liquid that is substantially immiscible with said first liquid phase As used herein, the expression "binary liquid", means a composition that comprises two substantially immiscible liquid phases. That is, it settles to form two separate liquid phase s, as distinguished from an emulsion or dispersion in which one phase is distributed through the other.

The base oil employed in the composition according to the invention may be any of the conventionally used lubricating oils and is preferably a mineral oil, a synthetic oil or a mixture of mineral and synthetic oils. Mineral basestocks can be any conventionally refined basestocks, for instance solvent refined, hydrotreated, or isomerised, e.g., wax-isomerised, basestocks. Synthetic basestocks that may be used include poly-olefin, polybutene, alkylbenzene, esters, silicone oils, etc.

The base oil preferably has a $KV_{100}$ of from 3 to 50 cSt, more preferably from 4 to 10 cSt.

Preferably, the second liquid phase comprises an ester of a polybasic acid or anhydride thereof, preferably a dicarboxylic acid, and an alcohol which is polyol alcohol or a mixture of polyol and monohydric alcohols, preferably a mixture of a polyol and a monohydric alcohol. The polyol is preferably branched. More preferably, the second liquid phase comprises a complex alcohol ester that is the reaction product of a polyol of the general formula $$R(OH)_n$$

wherein

R is an aliphatic or cyclo-aliphatic hydrocarbyl group having 2 to 20 carbon atoms and n is at least 2, a polybasic acid or an anhydride thereof provided that the ratio of equivalents of said polybasic acid to equivalents of alcohol from said polyol is in the range from 1.6:1 to 2:1, and a monohydric alcohol, provided that the ratio of equivalents of said monohydric alcohol to equivalents of said polybasic acid is in the range from 0.84:1 to 1.2:1;

wherein said complex alcohol ester exhibits a pour point of less than or equal to −20° C., and a viscosity in the range from 100 to 700 cSt at 40° C.

Preferably, the polyol is selected from neopentyl glycol, trimethylolethane, trimethylolpropane, trimethylolbutane, monopentaerythritol, di-pentaerythritol and mixtures thereof, and is preferably trimethylolpropane. The dibasic acid or anhydride has preferably 2 to 12 carbon atoms. It can be selected from adipic, azelaic, sebacic and dodecanedioic acids, succinic anhydride, glutaric anhydride, adipic anhydride, maleic anhydride, phthalic anhydride, nadic anhydride, methylnadic anhydride, hexahydrophthalic anhydride and mixed anhydrides of polybasic acids. Preferably the monohydric alcohol has 5 to 13 carbon atoms, more preferably it has 10 carbon atoms.

Preferred complex esters comprise the polyol, the polybasic acid or anhydride, and the monohydric alcohol in a ratio of substantially 1:3:3, or substantially 1:3:2.

Information as to the manufacture of such complex alcohol esters may be found in WO 98/10040, WO 98/10041 and WO 98/45389. These esters are generally known as complex alcohol esters (CALE). Initially, attempts were made to find methods of solubilizing various forms of CALE, because of its low solubility in engine oils. It has surprisingly been found, however, that a two-phase system with engine oil as the first phase, and a CALE as the second phase, although the phases are essentially immiscible, provides an engine oil that exhibits both improved fuel economy and fuel economy retention.

The complex alcohol esters with the above mentioned ratios 1:3:3 and 1:3:2 respectively have the stylised structures (A) and (B) respectively.

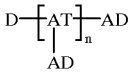

(A)

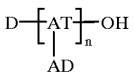

(B)

In these formulae, D represents an alkyl group derived from the monohydric alcohol, A represents of the acid moiety, and T represents the group derived from the polyol. n represents the number of repeating units, and the esters are typically mixtures with n being from 1 to 3.

As used in the Examples below, CALE typically has the following properties:

$KV_{100}$ 5–100 cSt, more preferably 10–60 cSt, most preferably 15–20 cSt

VI 80–180, preferably 100–160, most preferably 120–150

Because of their relatively high molecular weight, which is preferably in the range of 500 to 1500, and with the preferred esters of formula (A), having molecular weights from 700 to 1100, the complex alcohol esters are used as mixtures of the complex ester of formula A or of formula B, with a diluent, which can be conveniently an ester of a dicarboxylic acid and a monohydric alcohol, such as diisodecyl diadipate (DIDA) or ditertiary decyl adipate (DTDA). Diisodecyl phthalate, or other solvents, may be used if desired. The proportion of complex alcohol ester to diluent is preferably from 10:1 to 1:10 by volume, more preferably from 5:1 to 1:5 and especially from 2:1 to 1:1 by volume.

The diluent is used in the mixture because undiluted CALE of the operable molecular weight range is too viscous for convenient handling. It is found that when the diluted CALE is mixed with the engine oil, the CALE, with a minor proportion of the diluent, separates as the lower phase, with the major proportion of the diluent passing into the upper phase of engine oil.

Thus in another aspect the invention provides a lubrication system comprising:

(a) a first liquid comprising a base oil having a $KV_{100}$ of from 2 to 100 cSt, and (b) a second liquid comprising a polar organic liquid and a diluent, the polar organic liquid being substantially immiscible with the first liquid such that when the two liquids (a) and (b) are mixed they settle to form a two-phase liquid comprising a first phase that is rich in the said base oil and a second phase that is rich in the said polar organic liquid. The said diluent may be present in both the first and second phases.

Conveniently the diluent selected is the same as the solvent that is used in the preparation of the CALE, for example the diluent is DIDA or DTDA. Thus the method for preparing the CALE can provide a ready-diluted product without the need to add further diluent before the CALE is incorporated into the lubrication system of the present invention.

The lubrication system according to the present invention may contain one or more conventional lubricant additives as are well known to the person skilled in the art. The actual additives selected will depend on the intended application of the lubricant, but typically will include one or more of viscosity index ('VI') improvers, pour point depressants, detergents, dispersants, antioxidants, antiwear agents, corrosion inhibitors, antifoam agents, other friction modifiers and the like. The VI improver, detergent and dispersant are each preferably included in an amount from 0.5 to 10 wt % based on the total weight of the lubricant composition. The other additives are each preferably included in an amount from 0.01 to 5 wt % based on the total weight of the lubricant composition. These additive treat levels refer to the amount of active ingredients, i.e., the actual additive component, and do not include any diluent or carrier fluid. These additives may be dissolved or dispersed into either the first, base oil phase or the second, organic polar liquid phase, or may be distributed across both phases. Preferably, however, the additives are incorporated into the first, base oil phase. Indeed an advantage of the present invention is that the immiscible organic polar liquid phase may be combined with an already formulated lubricant, e.g., a fully formulated engine oil. The improvement in fuel economy and fuel economy retention benefit brought by the immiscible polar organic liquid appears to be largely independent of the nature of the base oil and lubricant additive s selected for the major portion of the lubrication system.

Thus in a further aspect the present invention provides a lubrication System comprising:

(a) a first liquid phase comprising fully formulated lubricant composition, and (b) a second liquid phase comprising a polar organic liquid that is substantially immiscible with said first liquid phase.

Preferably the first liquid phase is a fully formulated crankcase lubricant suitable for use in an internal combustion engine.

The present invention also provides the use of a composition as described herein in lubricating an engine to improve fuel economy, and/or to improve fuel economy retention.

The present invention also provides a method of lubricating an internal combustion engine which comprises adding to the engine a lubricant composition as defined above. In this method, phases (a) and (b) can be combined before they are added to the engine, they can be added to the engine simultaneously, or they can be added to the engine sequentially.

Where CALE is used in a single blend, which includes the ester [a], base oil [b] and additives [c] together, this composition exhibits higher fuel economy than does a mixture of [b] and [c], which is the conventional engine oil composition. The CALE content may be 1 to 30% by weight based on the total weight of the mixture of [a], [b] and [c], preferably, 1 to 20%, more preferably 5–10% by weight.

Where CALE is added separately, with [a] being added to the engine after the mixture of [b] and [c], immediately or after a certain period, the fuel economy is surprisingly improved after addition of [a]. The amount of CALE may be 1 to 30% by weight, based on the total weight of the final mixture of [a], [b] and [c], preferably 1 to 20%, by weight more preferably 5–10% by weight. In addition, it has been found that this improved fuel economy may be retained for a duration equivalent to at least 10,000 miles.

Where an engine is treated with [a], before being filled with a mixture of [b] and [c], so that CALE is added in a manner analogous to flushing oil, or pre-treatment oil for flushing or break-in, the CALE is believed to coat the metal surface, leading to lower friction and reduced wear. Thus, this modified surface is responsible for improved fuel economy and wear-protection for a long service period compared to the operation without CALE treatment. The preferred amount of [a] for this purpose may be 50 to 100% by weight based on the weight of oil required in the engine specification.

A further embodiment of the invention provides a method of lubricating an internal combustion engine which comprises adding to the engine a polar organic liquid, operating the engine, and subsequently adding to the engine a lubricating oil having a $KV_{100}$ in the range from 10 to 100 cSt, the polar organic liquid and the lubricating oil being substantially immiscible. If desired, the polar organic liquid is drained from the engine before addition of the lubricating oil. It is found that the effect of adding the polar organic liquid persists for an extended period, compared with using the lubricating oil alone.

In the following examples, the effectiveness of the two-component lubricant system of the invention has been demonstrated by means of the M-111 fuel economy test. There are two forms of this test: an initial fuel economy test and an extended fuel economy test.

In this test, a Mercedes M111 E29, 2 litre, 4 cylinder, 16 valve, DOHC engine runs on a test bench. The operation mode is the ECE & EUDC test cycle.

ECE @ 20, 33 and 75° C. (oil gallery)

EUDC @ 88° C. (oil gallery)

The reference oils were

RL 191:baseline reference oil

15W40, SH performance and HTHS>3.5 cP

RL 190:high detergency flushing oil

The initial fuel economy test

The first stage is the measurement of fuel consumption whilst running the reference oil (RL191), duration 2.5 hours. The reference oil is replaced with a candidate by the so-called flying flush system. The flying flush allows oils to be changed without the need to stop the engine. Using this procedure has been shown to improve the day-to-day repeatability of the test significantly. Following the flying flush, an initial fuel economy measurement of 2.5 hours is performed for the candidate oil (1st cycle). The engine operation continues for a further 6 hours under ageing conditions, following by a further 2.5 hour fuel consumption measurement (2nd cycle). The 6 hour ageing and subsequent 2.5 hour measuring cycles are then repeated (3rd cycle). The fuel consumption of the third cycle is recorded as the test result and is expressed as the fuel economy improvement (%) over the 15W-40 reference oil.

Before any Fuhrer candidate oil is tested the engine is flushed for one hour with the high detergency flushing oil (RL 190). Engine stoppage is not allowed at any stage within the test. Although this test includes two six-hour ageing cycles, the fuel economy result is often termed as the initial fuel economy result. This acknowledges the fact that the two six-hour cycles are designed to allow the oil to "bed-in" (i.e., friction modifier activation) rather than to degrade the oil chemically.

Extended fuel economy test

The extended M111 engine test, named M111E, is based on an experimental procedure developed by the Applicants for measuring fuel economy retention.

In the extended test, the M111 test cycles (the initial three test cycles constitute the standard M111 fuel economy test) are repeated 21 times. Each test cycle is followed by a period of steady state ageing. For the M111E test, ageing has been extended to be equivalent to 500 miles. The total test is thus equivalent to about 10,000 miles, and takes about 185 hours. Fuel consumption measurements are taken at every cycle, hence every 500 miles. The fuel consumption of the reference oil RL 191 is measured both at the beginning and end of the test, thereby allowing uninterrupted ageing of the candidate oil. Correction of possible engine drift during the test is normally performed by use of a moving average.

The invention will be further described with reference to the following non-limiting Examples.

EXAMPLE 1

(Comparative)

For comparative purposes, a conventional engine oil formulation was tested in fuel economy. The oil comprises, by weight based on the total weight of the oil, 79% of poly-α-olefin, 5% of viscosity index improver and 16% of a conventional engine oil additive package. The viscosity characteristics of the finished oil were within 5W-30 grade of the SAE J300 classification. The initial fuel economy was measured with a Mercedes M111 engine in compliance with the method, CEC L-54-T-96. Fuel economy is represented as percentage improvement of fuel consumption over the reference oil of the 15W-40 grade. The oil of Example 1 shows 1.67% fuel economy over the reference oil.

EXAMPLE 2

Test oils were prepared by mixing CALE, diluted with diisodecyl adipate in the proportion of CALE to diisodecyl adipate of 3:2 by volume, and together with the same conventional additive package, VI improver and poly-α-olefin as used in Example 1. The oil compositions are in Table 1. The initial fuel economy of oils was evaluated by the same procedure as in Example 1. The results demonstrated that increasing the quantity of CALE improved fuel economy by amounts in the range 2.00 to 3.51% over reference oil.

TABLE 1

| Example number | 2-1 | 2-2 | 2-3 | 2-4 |
|---|---|---|---|---|
| Poly-olefin (wt %) | 74.4 | 69.6 | 64.75 | 64.75 |
| Additive package (wt %) | 16.0 | 16.0 | 16.0 | 16.0 |
| VI improver (wt %) | 4.6 | 4.4 | 4.25 | 4.25 |
| CALE (diluted) (wt %) | 5.0 | 10.0 | 15.0 | 15.0 |
| % F.E. improvement | 2.00 | 2.51 | 3.51 | 2.60 |

In Example 2–4 the insoluble part of the CALE (i.e., all that which separated as a lower phase) was removed. The lower fuel economy improvement shows that it is the insoluble portion which is largely responsible for the improved fuel economy.

EXAMPLE 3

The test was started with the oil used in Example 1 under the same procedure as in Example 1. After the measurement of initial fuel economy, 700 ml of the diluted CALE, that is 10% by volume based on the total volume of the oil, as used in Example 2, was added and mixed with the running oil without stoppage of engine operation. The engine operation was continued thereafter and fuel economy was measured periodically as per the M111E test described above. After addition of CALE, fuel economy improvement gradually increased and reached a steady state, ranging from 2.7 to 3.0% improvement after a period equivalent to about 2,000 miles services. The range of fuel economy improvement was about 1% greater than the last measurement before adding CALE, and was retained until the end of the test. The total operating time was translated to 10,000 miles service period.

EXAMPLE 4

This example demonstrates the superior fuel economy performance achieved by operating an engine with the binary system according to the invention, by firstly adding the diluted CALE phase followed by a fully formulated engine oil, relative to the performance of the engine oil alone.

The test was run in a 1.8 litre gasoline Ford Mondeo vehicle on a chassis dynamometer. The vehicle was equipped with a fuel meter to enable the amount of fuel consumed per unit of brake horse power produced to be measured. To establish a base case fuel consumption the engine was operated for three days using the reference oil RL191, and the fuel consumption measured. The engine was then operated for two days with the fully synthetic engine oil formulation used in Example 1 above and the fuel consumption measured. Next the reference oil RL191 was run again for two days to ensure the base case fuel consumption stayed the same. Finally, the engine was operated using a binary system: 700 ml of the diluted CALE of Example 2 above was added to the engine and the engine operated for 20 minutes to condition the engine surface with the oil-insoluble CALE. The engine was then stopped and drained to remove the excess CALE phase. 6.3 litres of the fully synthetic engine oil used above was then added, the engine operated for two days and the fuel consumption measured.

The results showed that the synthetic engine oil formulation (without the CALE phase) gave a fuel economy performance over the base reference oil RL191 of 0.67%, whereas the addition of the CALE phase followed by the synthetic engine oil formulation gave 3.11%, a significant performance improvement.

What is claimed is:

1. A two phase lubrication system comprising a) a first liquid phase comprising a base oil having a kinematic viscosity at 100° C. in the range from 10 to 100 cSt, and b) a second polar organic, liquid phase that is substantially immiscible with said first liquid phase, the second phase comprising a complex ester of a monohydric alcohol, a polyol, and a polybasic acid, and a diluent wherein the diluent is an ester of a dicarboxylic acid and a monohydric alcohol and wherein the volume ratio of complex ester to dilent is in the range of 10:1 to 1:10.

2. A lubrication system as claimed in claim 1, wherein the second liquid phase comprises a complex ester that is the reaction product of a polyol the general formula $$R(OH)_n$$

wherein

R is an aliphatic or cyclo-aliphatic hydrocarbyl group having 2 to 20 carbon atoms and n is at least 2, a polybasic acid or an anhydride thereof provided that the ratio of equivalents of said polybasic acid to equivalents of alcohol from said polyol is in the range from 1.6.1 to 2:1, and a monohydric alcohol, provided that the ratio of equivalents of said monohydric alcohol to equivalents of said polybasic acid is in the range from 0.84:1 to 1.2:1;

wherein said complex alcohol ester exhibits a pour point of less than or equal to −20° C., and a viscosity in the range from 100 to 700 cSt a t 40° C.

3. A lubrication system as claimed in claim 2 wherein the polyol is selected from neopentyl glycol, trimethylolethane, trimethylolpropane, trimethylolbutane, monopentaerythritol, di-pentaerythritol and mixtures thereof.

4. A lubrication system as claimed in claim 3 wherein the dibasic acid or anhydride has 2 to 12 carbon atoms.

5. A lubrication system as claimed in claim 4 wherein the dibasic acid or anhydride is selected from adipic, azelaic, sebacic and dodecanedioic acids, succinic anhydride, glutaric anhydride, adipic anhydride, maleic anhydride, phthalic anhydride, nadic anhydride, methylnadic anhydride, hexahydrophthalic anhydride and mixed anhydrides of polybasic acid.

6. A lubrication system as claimed in claim 5 wherein the monohydric alcohol has 5 to 13 carbon atoms.

7. A lubrication system as claimed in claim 6 wherein the complex ester comprises the polyol, the polybasic acid or anhydride, and the monohydric alcohol in a ratio of substantially 1:3:3 or 1:3:2.

8. A lubrication system as claimed in any preceding claim wherein the phases (a) and (b) are combined before use or during the course of use.

9. The lubrication system of claim 1 wherein the diluent ester is selected from the group consisting of diisodecyl diadipate, ditertiary diayl adipate, and diisodecyl phthalate.

10. A method of lubricating an internal combustion engine which comprises adding to the engine a lubrication system as in any one of claims 1, 2 to 7, or 9 inclusive, and operating the engine.

11. A method as claimed in claim 10 wherein phases (a) and (b) are combined before they are added to the engine.

12. A method as claimed in claim 10 wherein phases (a) and (b) are added to the engine simultaneously.

13. A method as claimed in claim 10 wherein phases (a) and (b) are added to the engine sequentially.

14. A method as claimed in claim 10 wherein phase (b) is added to the engine before phase (a).

15. A method as claimed in claim 14 wherein excess phase (b) is drained from the engine before phase (a) is added.

* * * * *